US007371158B2

(12) United States Patent
Tanaka

(10) Patent No.: US 7,371,158 B2
(45) Date of Patent: May 13, 2008

(54) PLATING REMOVING APPARATUS FOR TWO-PIECE WHEEL

(75) Inventor: Takeshi Tanaka, Higashiosaka (JP)

(73) Assignee: Work Co., Ltd., Higashiosaka-shi (JP)

( * ) Notice: Subject to any disclaimer, the term of this patent is extended or adjusted under 35 U.S.C. 154(b) by 0 days.

(21) Appl. No.: 11/499,858

(22) Filed: Aug. 7, 2006

(65) Prior Publication Data

US 2007/0037497 A1 Feb. 15, 2007

(30) Foreign Application Priority Data

Aug. 9, 2005 (JP) ..... 2005-230441
Jun. 5, 2006 (JP) ..... 2006-155686

(51) Int. Cl.
*B24B 7/00* (2006.01)

(52) U.S. Cl. ..... 451/71; 451/299; 451/307

(58) Field of Classification Search ..... 451/301, 451/303, 299, 307, 71, 61; 408/87
See application file for complete search history.

(56) References Cited

U.S. PATENT DOCUMENTS 2,604,735 A * 7/1952 Kline ..... 451/49
2,798,340 A * 7/1957 Roberts ..... 451/304
2,828,586 A * 4/1958 List et al. ..... 451/304
6,001,006 A * 12/1999 Pineau et al. ..... 451/297
6,089,962 A * 7/2000 Spinasse ..... 451/296
6,746,315 B2 * 6/2004 Klukos ..... 451/50

FOREIGN PATENT DOCUMENTS

JP 59124502 A * 7/1984
JP 11-236681 8/1999

* cited by examiner

*Primary Examiner*—Eileen P. Morgan
(74) *Attorney, Agent, or Firm*—Kratz, Quintos & Hanson, LLP

(57) ABSTRACT

To provide a plating removing apparatus for 2-piece wheels, which can easily and beautifully remove plating at the welding planned portion on the rim inner circumferential surface and achieves 2-piece wheels with rims plated without requiring any troublesome operation, said apparatus comprising a pair of support rollers 13 horizontally arranged, a positioning member 15 that positions the rim 2 in the axial direction of the support roller 13, a pair of holding rollers 19 that hold the rim 2 between the support rollers 13 and the holding rollers 19, a rotation drive means that rotates and drives the rim 2 held between the support rollers 13 and holding rollers 19, and a grinding means that extends to an inside of the rim 2 for grinding the welding planned portion RW of the rim 2 with respect to the disk, and for removing plating of the relevant welding planned portion.

12 Claims, 9 Drawing Sheets

PLATING REMOVING APPARATUS FOR TWO-PIECE WHEEL

BACKGROUND OF THE INVENTION

1. Technical Field

The present invention relates to a plating removing apparatus for a two-piece wheel which removes plating of a welding planned portion on an inner circumferential surface of a rim in a the two-piece wheel which has the rim and a disk.

2. Background Art

Widely practiced vehicle wheels made of aluminum alloys and other light alloys, include a one-piece wheel integrally formed by molding, a two-piece wheel configured by dividing the wheel into two parts that are a rim and a disk, and a three-piece wheel configured by dividing the wheel into three parts that are an inner rim, an outer rim, and a disk. Wheels subjected to a treatment of chromium plating or other plating to enhance their design features are also extensively put into practical use (refer to Japanese Unexamined Patent Publication No. Hei 11-236681).

In general, it is common to configure a two-piece wheel by plating only a disk and a rim is not plated because of the following reasons.

That is, in the two-piece wheel, in a state that the disk is fitted and fixed to an inside of the rim by shrink-fitting, an inner circumferential surface of the rim and an outer circumferential surface of the disk are welded to integrate the two into one. In the event that the rim and the disk are subjected to a plating treatment, the two must be welded by removing plating layers of welding planned portions thereof in order to prevent welding defects of the disk with respect to the rim. Because the plating layer of the welding planned portion on the disk is outwardly exposed, it is comparatively easy to remove the plating layer manually by the use of portable grinder or the like. However, because the plating layer of the welding planned portion on the rim is formed on an inner circumferential surface of the rim, while the disk must be fixed to a proper position in the axial direction of the rim, there is a problem in that the plating layer cannot be accurately removed by hand using a portable grinder, or the like.

In addition, in place of a plating removing treatment by a portable grinder or the like, it is possible to provide a configuration in which formation of a plating layer at a welding planned portion is prevented by affixing a masking tape to the welding planned portions when a rim is subjected to a plating process. However, in such event, in order to affix the masking tape to a proper position, marks such as marking-off line must be formed on an inner circumferential surface of the rim, and the masking tape must be affixed along the marks, causing an extremely troublesome process. In addition, since the plating treatment requires a special technique which is not carried out by a wheel manufacturer but by a manufacturer specialized in the plating process, there is a problem of a labor charge increased for affixing the masking tape in the plating process, resulting in an increase of the wheel manufacturing cost. Furthermore, since an inner circumferential surface of the rim is formed with delicate irregularities, even if the masking tape is neatly affixed, parts of a welding planned portion may be plated by an invasion of plating liquid between the masking tape and the rim when the rim is immersed in the plating liquid. As shown in FIG. 10, there is yet another problem expected in a boundary part 103 adjacent to a base material part 101 in a welding planned portion of a rim 100, in which an elevated part 104 is formed along a side edge of the masking tape in a plated area 102, forming a level difference at the boundary 103 between the base material part 101 and the plated area 102. Accordingly, plating is easily exfoliated by a physical shock, and an incomplete plated area 105 including, for example, a copper plating layer in the case of chromium plating, is formed as a substrate layer by the plating liquid invaded between the masking tape and the rim, causing the plated area 102 to be easily exfoliated from the incomplete plated area 105.

Furthermore, there is considered a method to remove plating of a welding planned portion by cutting or the like in a machine process after performing a plating treatment, in place of a plating removal treatment by a portable grinder or the like. However, in such event, cutting the plated area by a single cutting treatment causes a force exerted on the plated area in the direction to exfoliate the plating when the cutting tool is withdrawn from the plated area, resulting in a problem of easy exfoliation of the plated area from the boundary adjacent to the base material portion. In addition, in order to prevent this, it is considered to insert the cutting tool from both side edges of the welding planned portion and to withdraw the cutting tool at halfway in the width direction of the welding planned portion. However, it is required to perform the cutting treatment twice, resulting in a troublesome process which is problematic.

SUMMARY OF THE INVENTION

Because of the reasons as mentioned above, it is possible to fabricate a two-piece wheel with a rim subjected to a plating process as a custom-made wheel, but such a wheel does not actually come into wide use. However, when a plating treatment is provided particularly for a disk in a two-piece wheel in order to enhance a design feature of the wheel, it is strongly demanded to use a rim subjected to a plating treatment.

It is the object of the present invention to provide a plating removing apparatus for two-piece wheel, which is capable of easily and neatly removing plating of a welding planned portion on an inner circumferential surface of a rim, and to realized a two-piece wheel with a rim subjected to a plating treatment without requiring any troublesome processes.

A plating removing apparatus for two-piece wheels related to the present invention is a plating removing apparatus which removes plating of a welding planed portion on an inner circumferential surface of a rim in a two-piece wheel composed of the rim and a disk, and includes a pair of support rollers horizontally arranged in which center axes thereof are set in parallel at an interval smaller than an outside diameter of the rim, a positioning member for positioning the rim supported on the support rollers in which a center axis of the rim is made substantially horizontal in the axial direction of the support roller, a pair of holding rollers for pressurizing the rim positioned and held on the support roller from above and holding the rim between the support rollers and the holding rollers, a rotation drive means for rotating and driving the rim held between the support rollers and holding rollers, and a grinding means that extends to an inside of the rim for grinding a welding planned portion of the rim adjacent to a disk and for removing plating of the welding planned portion.

When plating of a welding planned portion on a rim is removed by the use of this plating removing apparatus, the rim is placed on the support rollers in such a manner that a center axis of the rim is made substantially parallel to center axes of the support rollers, and the rim is pressurized by the holding rollers from above to hold the rim between the support rollers and the holding rollers, while the rim is being rotated at a low speed of, for example, 5 to 100 rpm by the rotation drive means to grind the welding planned portion by the grinding means, and to remove the plating of the welding planned portion.

It is possible to grind a bottom part of an inner circumferential surface of a rim by the grinding means. In such event, even when a plating portion of a different sized rim is removed, an inner circumferential surface of the rim to be ground is located in substantially the same height, thereby a welding planned portion of the rim can be subjected to a continuous grinding process without adjusting a height of the grinding means or a height of the rim.

As the grinding means, it is possible to adopt a grinding means comprising a drive pulley supported rotatably around a center axis thereof which is positioned substantially in parallel to a center axis of the support rollers, an idler pulley arranged by causing a center axis thereof to be made substantially vertical, a grinding belt stretched between the drive pulley and the idler pulley in which a direction thereof is changed at halfway by guide rolls, a drive means for grinding that rotates and drives the idler pulley, and a pressurizing means that presses the grinding belt stretched to the drive pulley against a welding planned portion of a rim. Because the grinding means is required to grind an inner circumferential surface of the rim, in the event that a grinding tool such as a grinding disk is used, a small-size tool must be adopted, and the grinding disk must be replaced frequently. In the present invention, a welding planned portion is ground by a grinding belt, thereby a drive pulley inserted in a rim can be configured to be compact and a durability of the grinding belt as a grinding tool can be increased. Furthermore, by bending a side edge part of the grinding belt pressurized to come in contact with an inner circumferential surface of the rim during grinding, a smooth surface can be formed between a welding planned portion in which plating was removed and a plated area without having a level difference.

As the pressurizing means, it is possible to adopt a pressurizing means having a support member that supports both the drive pulley and the idler pulley, a spindle that rotatably supports this support member so as to vertically move the support member on the drive pulley, and a tilting means that tilts the support member around the spindle. In the present invention, in a state that the grinding belt is separated from a rim by tilting the support member around the spindle by the tilting means, the rim is set to the support roller and the rim is moved outside the support roller while pressurizing the grinding belt to be in contact with the a welding planned portion of the rim, so as to grind plating at in the welding planned portion.

It is possible to use the plating removing apparatus comprising a position adjusting means in which a grinding position according to the grinding means can be adjusted in the axial direction of the rim. In such event, a welding planned portion subjected to grinding can be optionally adjusted in the axial direction. Consequently, for example, a rim with plating treatment provided is fabricated in advance, and the disk welding position to the rim axial direction can be adjusted in accordance with user requests.

A drill is installed for forming a valve fixing hole to the rim between the support rollers and a means for elevating this drill can be installed.

According to the plating removing apparatus for two-piece wheels related to the present invention, since plating of a welding planned portion is removed by grinding, plating at the welding planned portion can be neatly removed and welding defects of the disk with respect to the rim can be definitely prevented. In addition, as compared to the case of masking or cutting, it is possible to prevent a formation of an angular level difference formed at a boundary between a welding planned portion from which plating was removed and a plating portion, and exfoliation of plating from the boundary portion can be effectively prevented. Particularly when setting a part gently protruding to the inside of an inner circumferential surface of the rim as a welding planned portion, a smooth surface can be formed between the welding planned portion from which plating was removed and a plating portion without having a level difference, and exfoliation of plating can be effectively prevented at the boundary. Furthermore, since it is not required to affix a masking tape a labor charge used for a plating treatment can be minimized and cost for manufacturing a wheel can be reduced. In this way, even if plating treatment is provided to a rim, plating of a welding planned portion on an inner circumferential surface of the rim can be easily and neatly removed without requiring any complicated processes, and a two-piece wheel which has a plated rim can be realized at a low price.

If it is configured to grind a bottom part on an inner circumferential surface of a rim by the grinding means, the rim has substantially the same height in an inner circumferential surface of the rim to be ground by the grinding means, and it is not necessary to adjust a relationship in height between the grinding means and the rim even in the case of removing a plating portion of a different sized rim. Therefore, operability in removing plating can be remarkably improved.

If a grinding means equipped with a driving pulley, an idler pulley, an grinding belt, a drive means for grinding, and a pressurizing means is adapted as the grinding means stated above, durability of the grinding belt as a grinding tool can be increased while the drive pulley inserted in the rim is made to have a compact configuration, and a grinding process can be efficiently carried out. Furthermore a side edge part of the grinding belt pressed to be in contact with an inner circumferential surface of the rim is bent during grinding, thereby a smooth surface can be formed between a welding planned portion from which plating is removed and a plated area without having a level difference, and exfoliation of plating at the boundary can be effectively prevented.

If the pressurizing means is provided with a support member, a spindle, and a tilting means, a position of the grinding belt can be switched with a simple function between a state that the grinding belt is pressure-contacted to a suitable place of the rim and a state that the grinding belt is separated from the rim.

If a position adjusting means which can adjust a grinding position by the grinding means in the axial direction of the rim is provided, a welding planned portion subjected to grinding can be optionally changed in the axial direction. Consequently, if a rim subjected to a plating treatment is fabricated in advance, a welding position of a disk can be adjusted in the axial direction of the rim according to a request from a user.

If a drill for forming a valve fixing hole on a rim is installed between the support rollers while installing an elevating means for elevating this drill, it is made possible to carry out both a plating removal process in a welding planned portion and a process of forming a valve fixing hole on the rim by using a single apparatus.

BRIEF DESCRIPTION OF THE DRAWINGS

FIG. 7A is a view explaining a state that a rim is placed on support rollers; FIG. 7B is a view explaining a state that the rim is held by holding rollers; and FIG. 7C is a view explaining a state immediately before a grinding belt is inserted to the rim;

FIG. 8A is a view explaining a state that the grinding belt is inserted to a rim; FIG. 8B is a view explaining a state of grinding the welding planned place by the grinding belt; and FIG. 8C is a view explaining a state that a valve fixing hole is formed by a drill;

DETAILED DESCRIPTION OF THE INVENTION

Figure 1:
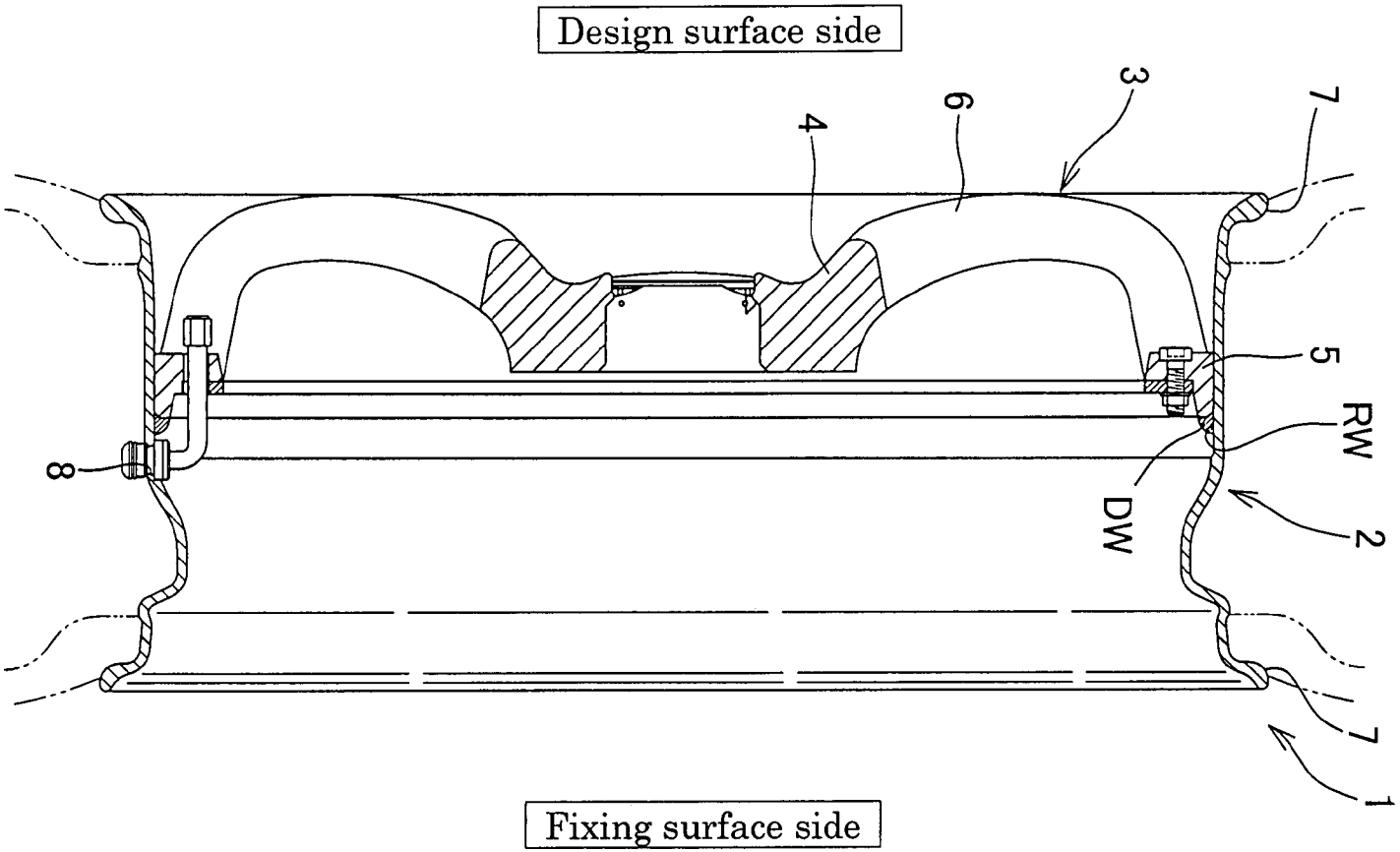
FIG. 1 is a cross-sectional view of a two-piece wheel.

Referring to the drawings, embodiments of the present invention will be described in detail hereinafter.

First of all, description will be made on a two-piece wheel 1.

As shown in FIG. 1, the two-piece wheel 1 is equipped with a substantially cylindrical rim 2 and a disk 3 that is arranged inside the rim 2 and welded to be fixed to an inner circumferential surface of the rim at the external edge portion.

The disk 3 is integrally formed using aluminum alloys and other lightweight metal material by casting, press-forming, and forging or the like, in which a whole surface of the disk 3 is subjected to a plating treatment by, for example, chromium-plating. The plating treatment is carried out by a widely known method to immerse the rim 2 in plating liquid, and plating of a welding planned portion DW on the disk 3 with respect to the rim 2 is removed by masking or grinding.

The disk 3 is equipped with a fixing part 4 to a wheel support member (omitted from drawings), an annular ring part 5 installed in such a manner to surround and enclose the fixing part 4, and a spoke part 6 that joins the fixing part 4 to the ring part 5.

The rim 2 is composed of metal material such as aluminum alloys that is excellent in stretchablility, in which a whole surface of the rim 2 is subjected to a plating treatment such as chromium plating. The plating treatment is carried out by a widely known method to immerse the rim 2 in plating liquid, in which plating of a welding planned portion RW on the rim 2 with respect to the disk 3 is removed by grinding carried out in a plating removing apparatus to be discussed below.

An end part on a design surface side and an end part on a fixing surface side of the rim 2 have a flange parts 7 formed by increasing a wall thickness to have a wall thicker than other parts. Because the flange part 7 is configured to have a thick wall by increasing the wall thickness as stated above, when the rim 2 is subjected to a plating treatment, plating liquid is securely prevented from remaining in the flange part 7 so that corrosion of the flange part 7 caused by the remaining plating liquid can be prevented. In addition, because the flange part 7 is configured to have a thick wall, strength and rigidity of a wheel 1 can be sufficiently secured during rotation or the like.

When the wheel 1 is assembled in a state that the disk 3 is fitted into a setting position in the axial direction of the heated rim 2 while cooling the rim 2 so as to fix the disk 3 to the rim 2 by shrink-fitting, both welding planed portions RW and DW are welded and assembled.

Next discussion is made on a plating removing apparatus 10 for removing plating of the welding planned portion RW on an inner circumferential surface of the rim 2.

Figure 2:
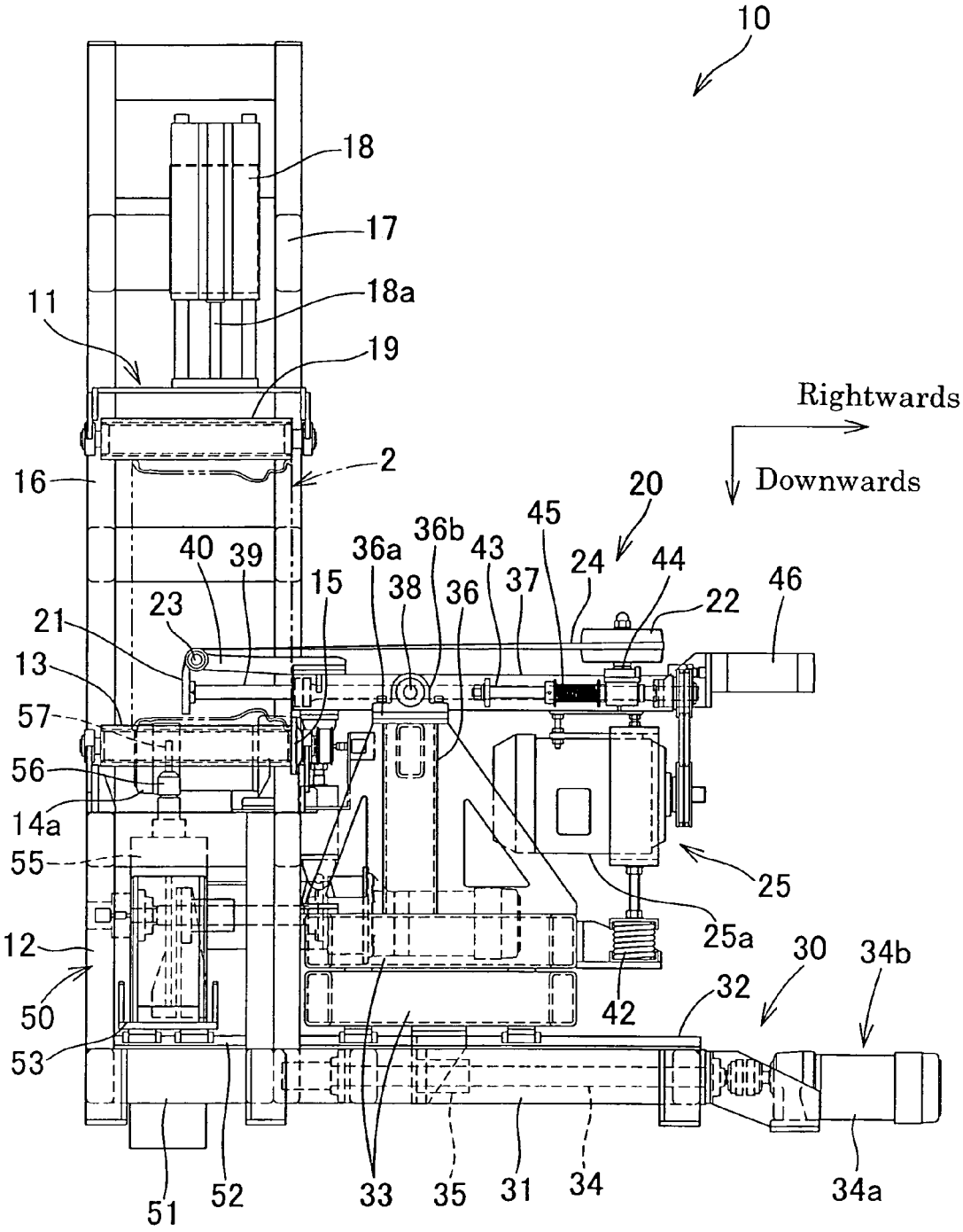
FIG. 2 is a front view of a plating removing apparatus in a state that a grinding means is moved to an advancing position.
Figure 3:
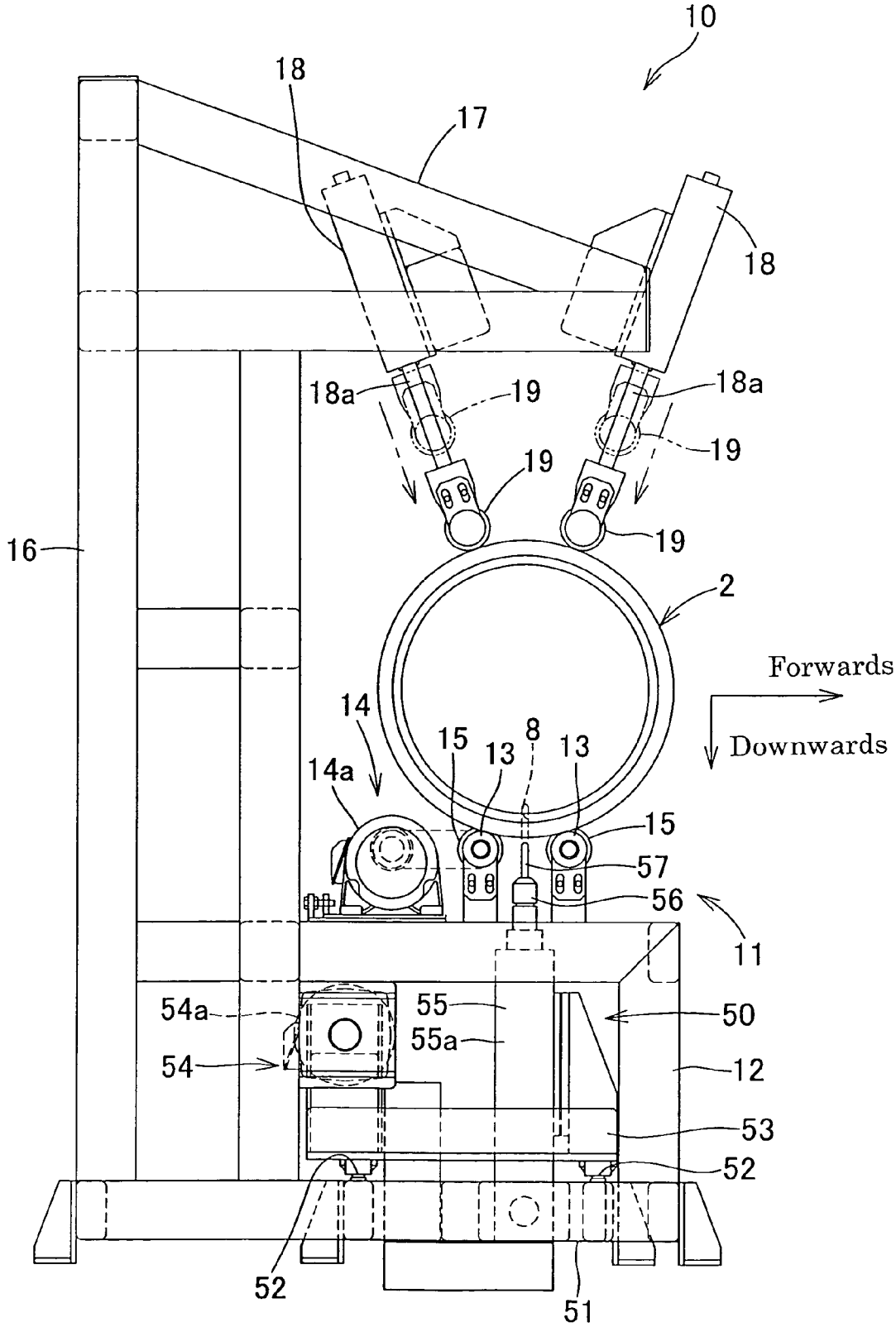
FIG. 3 is a left side view of the plating removing apparatus in a state that a wheel is held.
Figure 8:
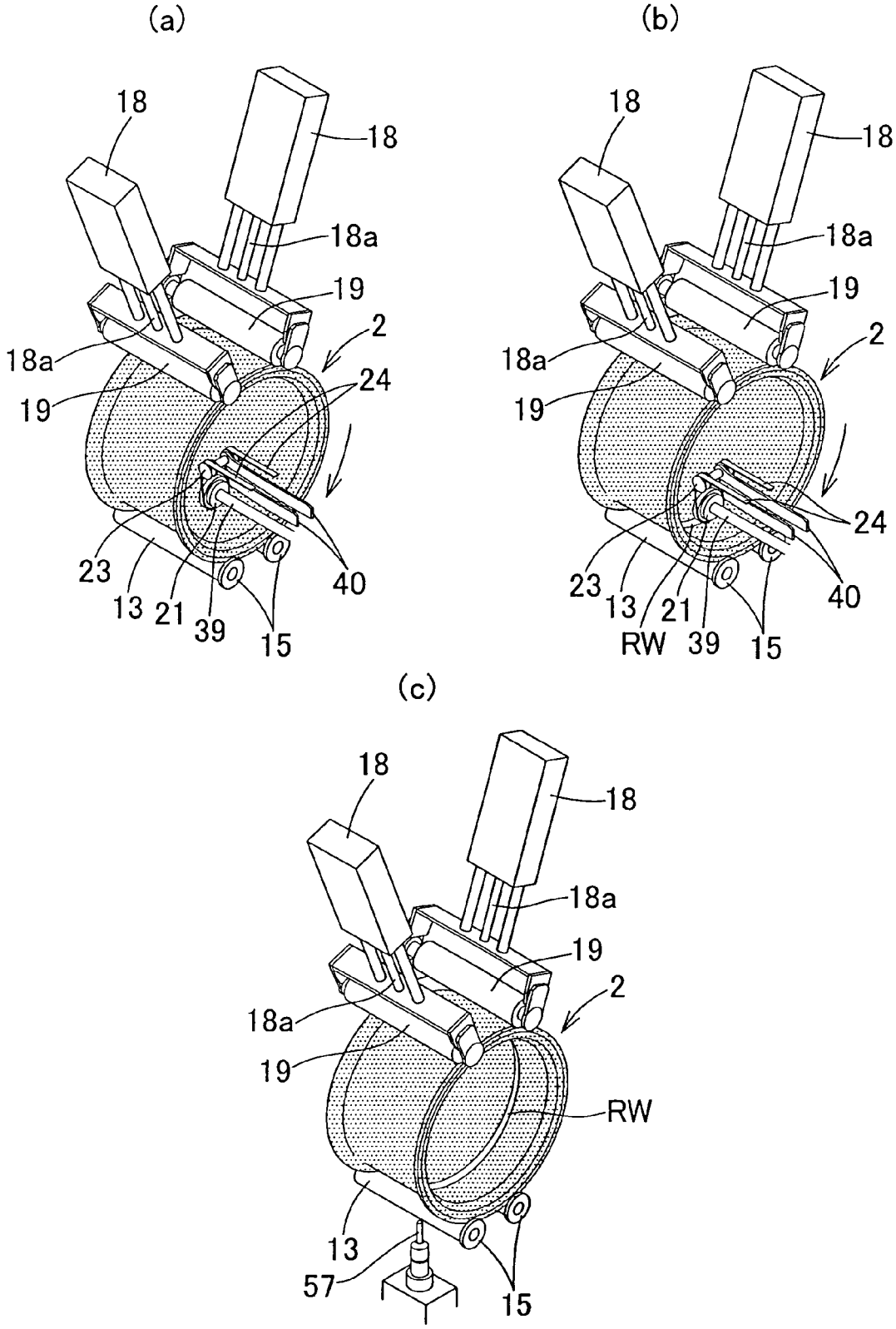
FIG. 8 shows an operating state of the plating removing means.

As shown in FIG. 1 through FIG. 3, the plating removing apparatus 10 is equipped with a rotating means 11 that rotates the rim 2 at a low speed in which a center axis thereof is made substantially horizontal, a grinding means 20 that extends to an inside of the rim 2 for grinding the welding planned portion RW (see FIG. 8(*c*)) on the rim 2 with respect to the disk 3 and for removing plating of the welding planned portion RW, and a drilling means 50 that forms a valve fixing hole 8 to the rim 2. However, the drilling means 50 may be omitted.

Figure 4:
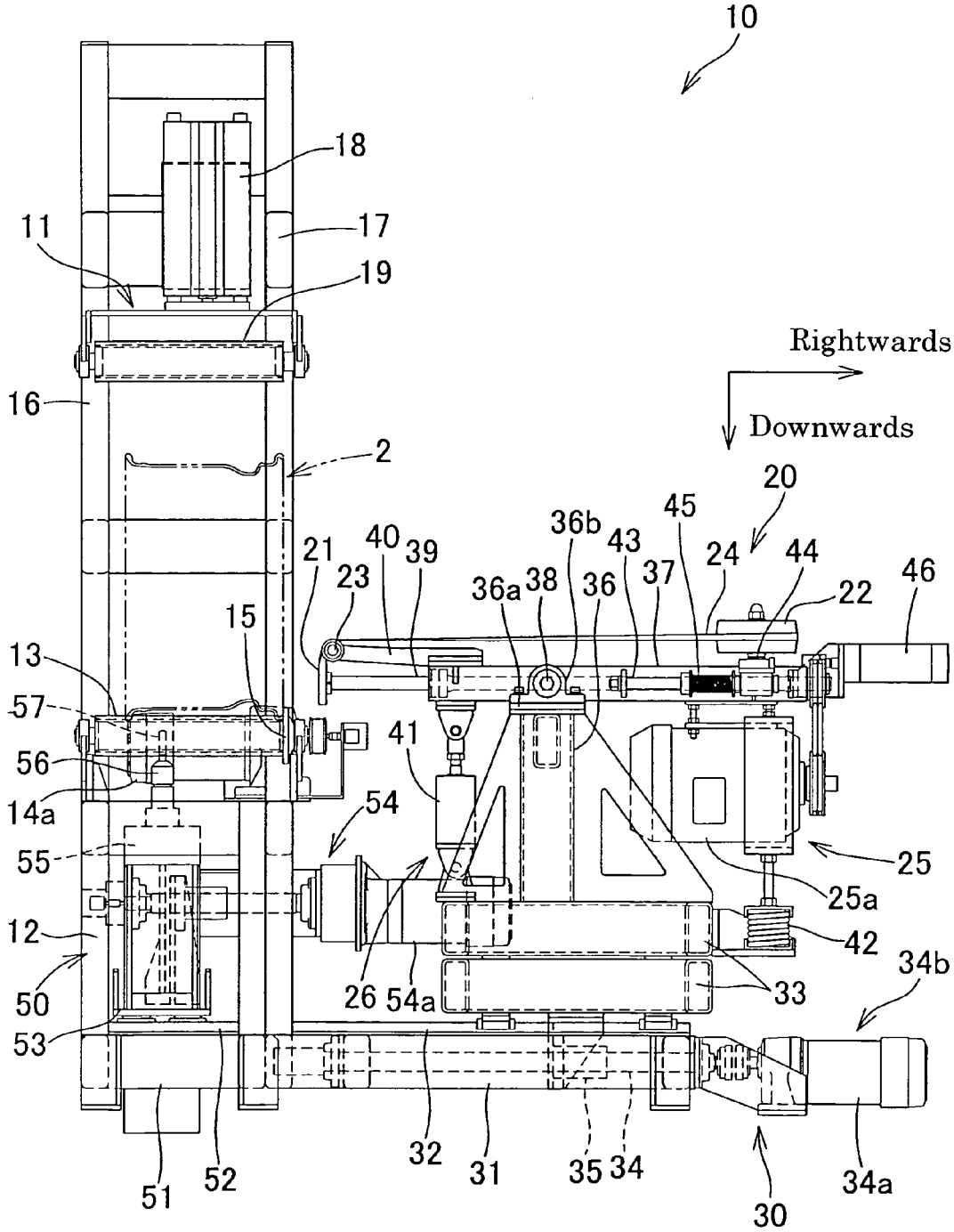
FIG. 4 is a front view of the plating removing apparatus in a state that a grinding means is moved to a reversing position.

The rotating means 11 will be explained. As shown in FIG. 2 through FIG. 4, the rotating means 11 comprises an anteroposterior pair of support rollers 13 horizontally installed to an upper side of a lower frame 12 in which a center axes thereof are directed in the horizontal direction by spacing an interval smaller than an outside diameter of the rim 2, a rotation driving means 14 mainly composed of an electrically-driven motor 14*a* that is installed behind the support rollers 13 for rotating and driving the support roller 13 on the rear side and a positioning member 15 installed on a right end part of the support roller 13 in a substantially disk form having a diameter larger than that of the support roller 13. The rim 2 is placed on both of the support rollers 13 in which center axis thereof is directed in the horizontal direction. A right end part of the rim 2 is made in contact with the positioning member 15, thereby the rim 2 is positioned in the axial direction.

A vertical frame 16 that extends upwards is installed behind the lower flame 12, in which a support frame 17 that extends forwards is installed to an upper end part of the vertical frame 16. An actuator 18 composed of an anteroposterior pair of air-cylinders or the like is installed to the support frame 17 in which output parts 18*a* of the actuators 18 are directed to a center position side of the rim 2 on both anteroposterior sides above the support rollers 13, and holding rollers 19 rotatably mounted on top end parts of the output parts 18*a* in which center axes thereof are directed in the horizontal direction. The holding rollers 19 are installed towards a center side of the rim 2 in a movable state between a retracting position indicated by virtual lines and a holding position indicated by solid lines as shown in FIG. 3, in which the rim 2 positioned and held on the support rollers 13 is held between the support rollers 13 and the holding rollers 19 by protruding the holding rollers 19 downwards by the actuators 18 so that the rim 2 is rotated in one direction at a low speed by rotating and driving the support rollers 13 under this condition by a rotation drive means 14.

As shown in FIG. 2 and FIG. 4 through FIG. 6, the grinding means 20 is equipped with a drive pulley 21 rotatably installed around a center axis in the horizontal direction, an idler pulley 22 rotatably installed around the center axis in the vertical direction, a guide roller 23 arranged above the drive pulley 21, a grinding belt 24 stretched between the drive pulley 21 and the idler pulley 22 in which a direction thereof is changed by the guide roller 23 at halfway, a drive means 25 for grinding that rotates and drives the idler pulley 22, and a pressurizing means 26 that presses the grinding belt 24 stretched to the drive pulley 21 against the welding planned portion RW of the rim 2. This grinding means 20 is supported by a position adjusting means 30 having the following configuration in which a grinding position is adjustable in the axial direction of the rim 2.

Now the position adjusting means 30 will be discussed. As shown in FIG. 2 and FIG. 4 through FIG. 6, a loading frame 31 that extends rightwards is installed to a lower part of the lower frame 12, in which an anterposterior pair of guide rails 32 that extend in the horizontal direction are installed, and a mobile table 33 is supported movably by the guide rails 32 in the horizontal direction. In order to adjust a position of the mobile table 33 in the horizontal direction, a screw shaft 34 that extends in the horizontal direction is installed in the loading frame 31. In a mid-part of the screw shaft 34, a female screw member 35 fixed to the mobile table 33 is mounted. On a right end part of the mobile table 33, a drive means 34*b* primarily composed of an electrically-operated motor 34*a* that rotates and drives the screw shaft 34 is installed. The mobile table 33 is configured to be movable in the horizontal direction between an advancing position illustrated in FIG. 2 and a reversing position illustrated in FIG. 4 by the drive means 34*b*.

The grinding means 20 will be explained. An anteroposterior pair of supports 36 that extend upwards are raised upright and fixed on the mobile table 33, in which a support plate 36*a* is fixed in such a manner to bridge a gap between upper end parts of the supports 36, and an anteroposterior pair of bracket members 36*b* are fixed on the support plate 36*a*. A support member 37 having a substantially cylindrical form is rotatably supported by both of the bracket members 36*b* around the spindle 38 in the longitudinal direction, in which guide rods 43 that extend in the horizontal direction are fixed to both longitudinal sides of a right part of the support member 37. Between both of the guide rods 43, a support plate 44 is movably installed in the horizontal direction. On the support plate 44, the idler pulley 22 is rotatably installed around a substantially vertical center axis. The idler pulley 22 is energized normally to the right side together with the support plate 44 by a spring member 45 externally mounted to the guide rod 43. To the support member 37, an actuator 46 having an air-cylinder that operates the support plate 44 leftwards is mounted and is configured to operate the support plate 44 and the idler pulley 22 to the left side against a force energized by the spring member 45. To the support member 37, a rotary shaft 39 that penetrates a substantially central part of the support member 37 and extends in the horizontal direction is rotatably mounted. To a left end part of the rotary shaft 39 that extends leftwards from the support member 37, the drive pulley 21 is installed. Above the rotary shaft 39, a support rod 40 that extends leftwards in a form of cantilever from the support member 37 is installed. To a left end of the support rod 40, an anteroposterior pair of the guide rollers 23 are mounted. Between the drive pulley 21 and the idler pulley 22, the grinding belt 24 is stretched in which a direction thereof is changed along the course by the guide rollers 23. On a lower side of a right part of the support member 37, the drive means 25 for grinding primarily composed of the electrically-operated motor 25*a* is installed. By rotating and driving the rotary shaft 39 by this drive means 25 for grinding, the grinding belt 24 is configured to orbit. To the grinding belt 24, proper tension is exerted by the spring member 45. Under this condition, it is configured to efficiently grind the rim 2 by the grinding belt 24 under the drive pulley 21. When the belt is replaced, the drive pulley 21 is operated to the left side by the actuator 46, thereby the grinding belt 24 is configured to be able to be easily replaced.

Now, the pressurizing means 26 will be discussed. Between a left end part of the support member 37 and the mobile table 33, an actuator 41 composed of an air cylinder or the like that tilts the support member 37 around the spindle 38 is installed. Between the mobile table 33 and the electrically operated motor 25*a*, a helical compression spring 42 for cushioning is installed. The support member 37 is configured to be supported by the actuator 41 in a tiltable state between a grinding position illustrated by solid lines and a retracting position illustrated by virtual lines in FIG. 5 and FIG. 6 so as to press the grinding belt 24 to be in contact with the welding planned portion RW in a bottom of the inner circumferential surface of the rim 2 at the grinding position.

The peripheral velocity of the grinding belt 24 at a welding planned portion is set to 150 to 600 m/min, the pressurizing force to the rim 2 is set to 0.5 kN to 1.5 kN, and the rotating speed of the rim 2 is set to 5 to 100 rpm so that the welding planned portion can be ground while the rim 2 makes one rotation. It is also possible to provide a configuration in which a grinding treatment is completed with the rim 2 is rotated for multiple times. A width of the grinding belt 24 is set to be equal to or slightly larger than that of the welding planned portion RW so as to grind plating of the welding planned portion RW by a single grinding treatment. However, the grinding treatment may be divided to be carried out for multiple times in the axial direction.

The drilling means 50 will be explained. Below and between support rollers 13, a guide rail 52 that extends in the horizontal direction is installed on a support frame 51, in which a drill support table 53 is movably installed on the guide rail 52 in the horizontal direction. The drill support table 53 is configured to be supported by a drive means 54 primarily composed of an electrically operated motor 54*a* in such a manner that a position thereof can be adjusted along the guide rail 52 and a position to form the valve fixing hole 8 can be adjusted in the axial direction of the rim 2. A drill drive means 55 primarily composed of an electrically-operated motor 55*a* is vertically and movably installed on the drill support table 53 by an elevating means not shown. To an upper end part of the drill drive means 55, a drill 57 is removably mounted via a chuck 56, in which the drill 57 is supported by the elevating means in a vertically movable state between a raised position illustrated by virtual lines in FIG. 3 where the drill 57 protrudes to an upper side of a bottom of the rim 2 to form the valve fixing hole 8, and a lowered position illustrated by solid lines in FIG. 3 where the drill 57 is moved below the rim 2.

Now, an operation of the plating removing apparatus 10 is described.

Figure 7:
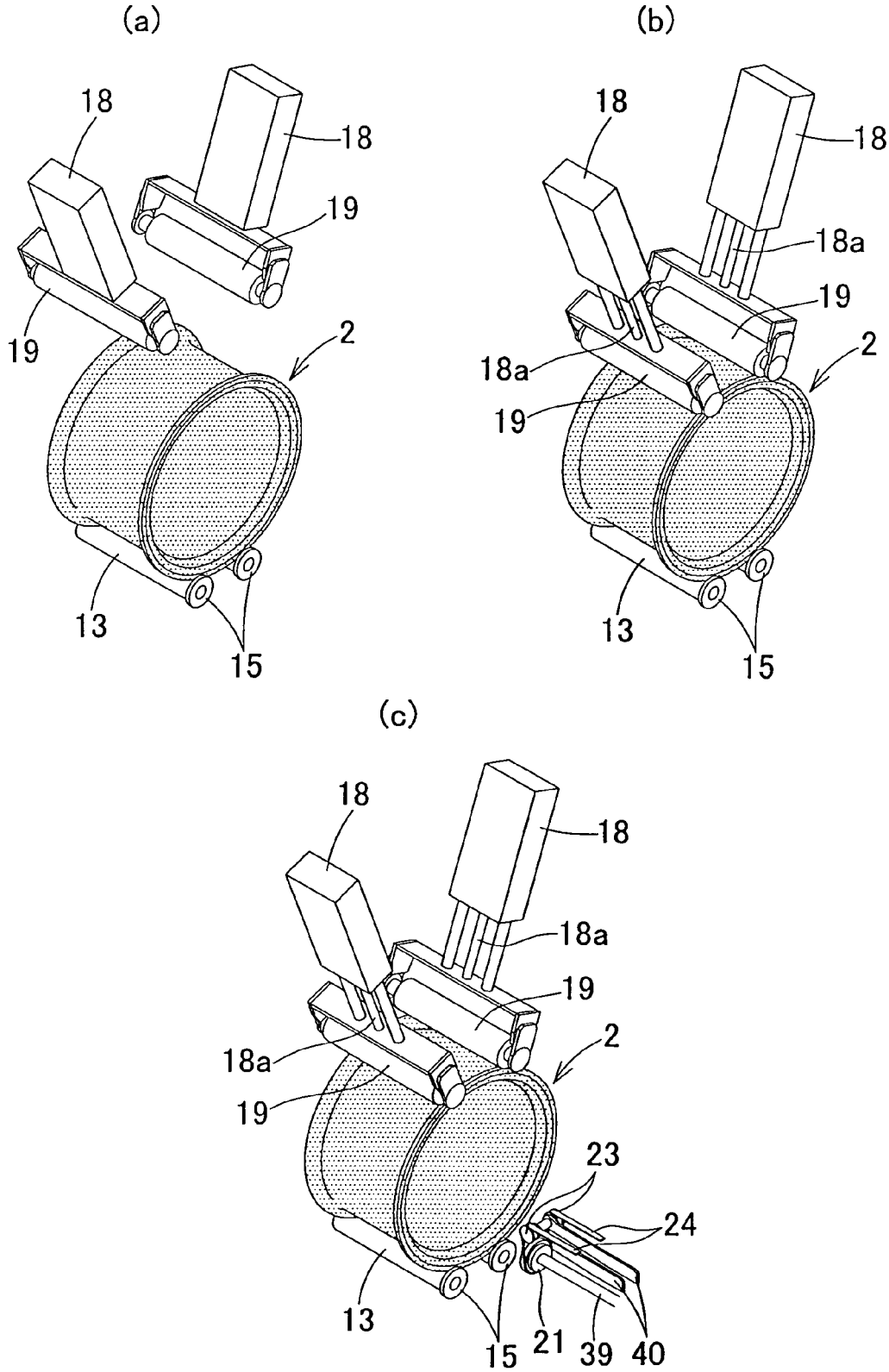
FIG. 7 shows an operating state of a plating removing means.

First of all, in a state that the grinding means 20 is moved to the reversing position by the position-adjusting means 30 and the drill 57 is moved to the lowered position as shown in FIG. 4, the rim 2 is loaded on the support rollers 13 in which a center shaft thereof is directed in the horizontal direction, and an end part of the rim 2 is brought in contact with the positioning member 15 so that the rim is positioned and set in the horizontal direction as shown in FIG. 4 and FIG. 7(*a*).

Then, as shown in FIG. 3 and FIG. 7(*b*), the holding roller 19 is protruded downwards by the actuator 18 so that the rim 2 is held between the support rollers 13 and the holding rollers 19.

Figure 5:
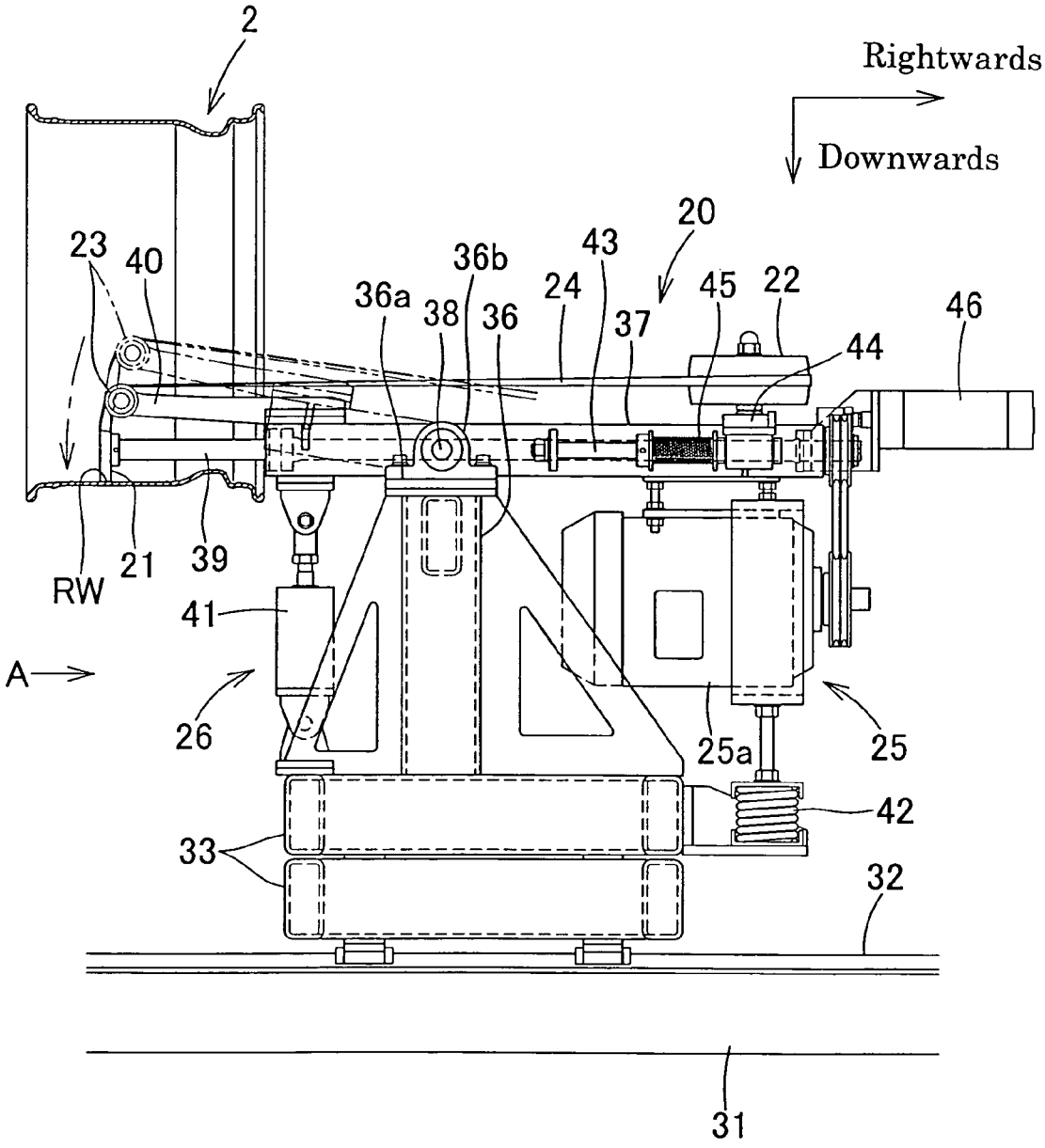
FIG. 5 is a front view of the grinding means.
Figure 6:
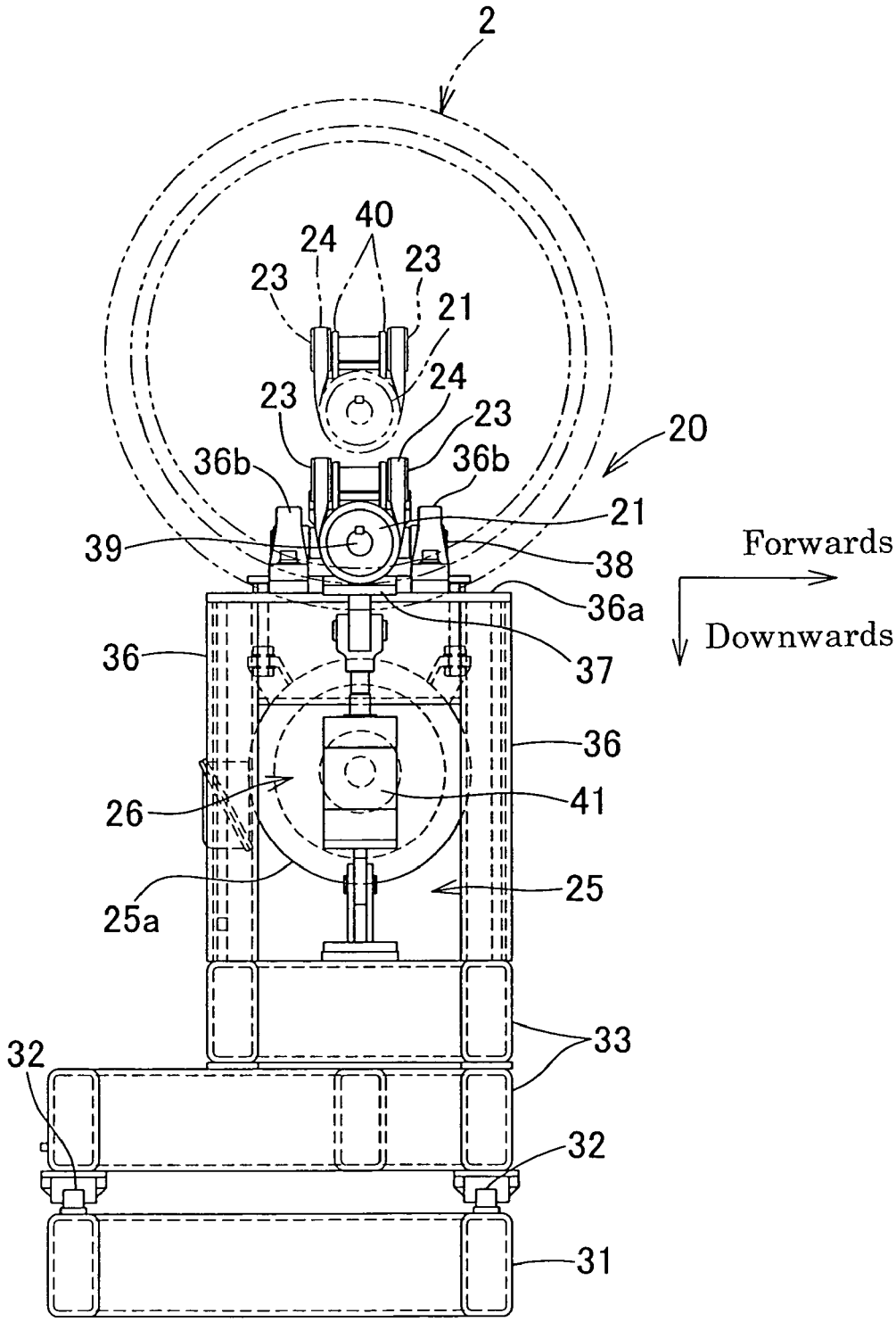
FIG. 6 is a view on indicated by an arrow A shown in FIG. 5.

Then, in a state that the support member 37 is tilted to the retracting position illustrated by virtual lines in FIG. 7(*c*) and FIG. 5 by the actuator 41, the grinding means 20 is moved to the advancing position by the position adjusting means 30 as shown in FIG. 8(*a*).

Then, the support roller 13 is rotated by the rotation drive means 14 and the rim 2 is rotated at a low speed with a rotating speed of, for example, 10 rpm while the grinding belt 24 is orbited by the electrically-operated motor 25*a*, and then, as illustrated by solid lines in FIG. 8(*b*) and FIG. 5, the support member 37 is tilted to a grinding position by the actuator 41, the grinding belt 24 applied to the drive pulley 21 is pressed to be in contact with the welding planned portion RW of the bottom in the inner circumferential surface of the rim 2 rotating at a low speed, the welding planned portion RW of the rim 2 rotating at a low speed is successively ground, and plating in the welding planned portion RW is successively removed.

After plating of the welding planned portion RW is removed throughout the whole circumference by a single rotation of the rim 2, the support member 37 is returned to the retracting position illustrated by virtual lines in FIG. 5 by the actuator 41, while separating the grinding belt 24 from the inner circumferential surface of the rim 2, and suspending the rotation of the rim 2 by the drive means 25 for grinding. Under the above stated condition, the drill 57 is raised and lowered by the elevating means as shown in FIG. 3 while rotating the drill 57 by the drill drive means 55 as shown in FIG. 8(*c*) so as to form the valve fixing hole 8. However, it is possible to provide a configuration in which plating of the welding planned portion RW is removed after the valve fixing hole 8 is formed by the drill 57.

Then, the grinding means 20 is moved to the reversing position by the position adjusting means 30, the holding roller 19 is moved above the rim 2 by the actuator 18, the rim 2 is removed and a new rim 2 is set to the support roller 13 so that a removal of plating in the welding planned portion RW and a formation of the valve fixing hole 8 are carried out in the same manner stated above.

Figure 9:
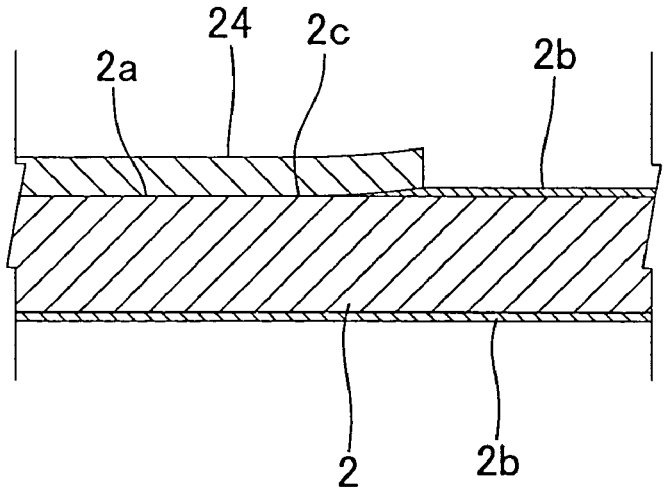
FIG. 9 is a view explaining a ground area by the grinding belt.
Figure 10:
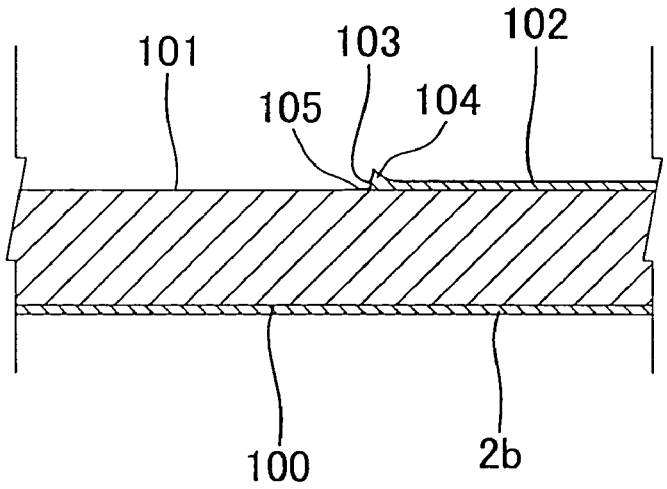
FIG. 10 is a view explaining a state that the base material part is exposed at the welding planned portion by masking.

In this plating removing apparatus 10, at the time of grinding the welding planned portion RW by the grinding belt 24, the side edge of the grinding belt 24 is subtly bent as shown in FIG. 9, thereby the base material surface 2*a* of the welding planned portion RW after plating is smoothly connected to the surface of the plated area 2*b* without forming a level difference at the boundary 2*c* in-between. Therefore, it is made possible to effectively prevent non-conformity in that the plating portion 2*b* exfoliates from the boundary 2*c* during welding or others.

In addition, since plating of the welding planned portion RW is removed by grinding, it is made possible to neatly remove plating of the welding planned portion RW in a substantially complete state, and welding defects of the disk 3 with respect to the rim 2 can be securely prevented. Moreover, since it is possible to plate the whole surface of the rim 2 without affixing a masking tape, a labor charge spent on a plating treatment can be minimized and a manufacturing cost of a wheel 1 can be reduced.

Because the bottom of the inner circumferential surface of the rim 2 is ground, even if a plated area of rim 2 in a different size is removed, the same heights is obtained in the inner circumferential surfaces of rims 2 subjected to be ground by the grinding means 20, and there is no need to adjust a relationship in height between the grinding means 20 and the rim 2. Therefore, operability in removing plating can be remarkably improved.

Because grinding can be carried out by the use of the grinding belt 24, it is made possible to increase durability of the grinding belt 24 as a grinding tool while the drive pulley 21 inserted in the rim 2 is made compact, thereby a grinding process can be efficiently carried out.

In addition, because a grinding position is adjustable in the axial direction of the rim 2 by the position adjusting means 30, it is possible to optionally change the welding planned portion RW to be ground in the axial direction. Consequently, if the rim 2 subjected to plating treatment is fabricated in advance, a welding position of the disk 3 in the axial direction of the rim 2 can be adjusted according to a request from a user.

In the present embodiment, the case in which the grinding belt 24 is used as a grinding tool was described, but grinding tools other than the grinding belt 24 such as flap wheel can also be used.

What is claimed is:

1. A plating removing apparatus for a two-piece wheel for removing plating of a portion to be welded on an inner circumferential surface of a rim in a two-piece vehicle wheel composed of the rim and a disk, comprising:

a pair of support rollers horizontally arranged with the center axes of the support rollers being set in parallel and spaced at an interval that is smaller than the outside diameter of the rim;

a positioning member that positions the rim supported on the support rollers with a center axis of the rim being made substantially horizontal in the axial direction of the support rollers;

a pair of holding rollers that pressurize the rim positioned and held on the support rollers from above and hold the rim between the support rollers and the holding rollers;

a rotation drive means that rotates and drives the rim held between the support rollers and holding rollers;

a grinding means that extends to an inside of the rim for grinding a portion of the rim to be welded, with respect to the disk, and for removing plating of the portion to be welded; and a drill for forming a valve fixing hole, wherein the drill protrudes to an upper side of a bottom of the rim, and a means for elevating said drill.

2. The plating removing apparatus according to claim 1, wherein the apparatus is structured so that the bottom part of the inner circumferential surface of the rim is ground by the grinding means.

3. The plating removing apparatus according to claim 1, wherein the grinding means has a drive pulley supported rotatably around a center axis of the drive pulley substantially parallel to the center axes of the support rollers, an idler pulley arranged with a center axis of the idler pulley being made substantially vertical, a grinding belt stretched from the drive pulley around guide rolls and the idler pulley, such that the direction of the belt between the drive pulley and the guide rolls is different from the direction of the belt between the guide rolls and the idler pulley, a drive means for grinding that rotates and drives the drive pulley, and a pressurizing means that presses the grinding belt stretched to the drive pulley against the portion of the rim to be welded.

4. The plating removing apparatus according to claim 3, further comprising:

a support member that supports both the drive pulley and the idler pulley to be spaced from each other, a spindle that rotatably supports this support member on a portion spaced from the drive pulley in the support member, and a tilting means that tilts the support member around the spindle, thereby vertically moving the drive pulley.

5. The plating removing apparatus according to claim 1, further comprising a position adjusting means capable of adjusting the position of the grinding means in the axial direction of the rim.

6. The plating removing apparatus according to claim 2, wherein the grinding means has a drive pulley supported rotatably around a center axis of the drive pulley substantially parallel to the center axes of the support rollers, an idler pulley arranged with a center axis of the idler pulley being made substantially vertical, a grinding belt stretched between the drive pulley and the idler pulley with a direction thereof being changed at halfway by guide rolls, a drive means for grinding that rotates and drives the drive pulley, and a pressurizing means that presses the grinding belt stretched to the drive pulley against a welding planned portion of the rim.

7. The plating removing apparatus according to claim 6, further comprising:

a support member that supports both the drive pulley and the idler pulley to be spaced from each other, a spindle that rotatably supports this support member on a portion spaced from the drive pulley in the support member, and a tilting means that tilts the support member around the spindle, thereby vertically moving the drive pulley.

8. The plating removing apparatus according to claim 2, further comprising a position adjusting means capable of adjusting the position by of the grinding means in the axial direction of the rim.

9. The plating removing apparatus according to claim 3, further comprising a position adjusting means capable of adjusting the position of the grinding means in the axial direction of the rim.

10. The plating removing apparatus according to claim 4, further comprising a position adjusting means capable of adjusting the position of the grinding means in the axial direction of the rim.

11. The plating removing apparatus according to claim 6, further comprising a position adjusting means capable of adjusting the position of the grinding means in the axial direction of the rim.

12. The plating removing apparatus according to claim 7, further comprising a position adjusting means capable of adjusting the position of the grinding means in the axial direction of the rim.

* * * * *